US005336794A

United States Patent [19]

Pryor et al.

[11] Patent Number: 5,336,794

[45] Date of Patent: Aug. 9, 1994

[54] DUAL PHASE ADSORPTION AND TREATMENT OF GLYCERIDE OILS

[75] Inventors: James N. Pryor, West Friendship; James M. Bogdanor, Columbia; William A. Welsh, Highland, all of Md.

[73] Assignee: W. R. Grace & Co.-Conn., New York, N.Y.

[21] Appl. No.: 561,850

[22] Filed: Aug. 1, 1990

Related U.S. Application Data

[63] Continuation-in-part of Ser. No. 191,094, May 6, 1988, which is a continuation-in-part of Ser. No. 863,208, May 14, 1986, abandoned.

[51] Int. Cl.[5] ..... C11B 3/10

[52] U.S. Cl. ..... 554/206

[58] Field of Search ..... 260/428; 554/206

[56] References Cited

FOREIGN PATENT DOCUMENTS 3537384 4/1987 Fed. Rep. of Germany .

7332132 4/1975 France .

*Primary Examiner*—José G. Dees

*Assistant Examiner*—Joseph M. Conrad

*Attorney, Agent, or Firm*—Steven Capella

[57] ABSTRACT

Impurities, which may include soaps, gums, phospholipids and pigments, can be removed from chemically or physically refined glyceride oils in a dual phase adsorption and treatment process. In the first phase, the oil is contacted with amorphous silica to remove phospholipids and soaps or gums or both. In the second phase, the oil is passed through a packed bed of a pigment removal agent for decolorizing glyceride oils.

33 Claims, No Drawings

DUAL PHASE ADSORPTION AND TREATMENT OF GLYCERIDE OILS

This is a continuation-in-part of copending U.S. Ser. No. 191,094, filed on May 6, 1988, which in turn is a continuation-in-part of copending U.S. Ser. No. 863,208, filed on May 14, 1986 (now abandoned).

BACKGROUND OF THE INVENTION

This invention relates to a method for refining glyceride oils by contacting the oils with adsorbents capable of removing certain impurities. More specifically, it has been found that glyceride oils can be treated with a combination of materials which serves to remove phospholipids, soaps and the like, facilitating decolorization of the oil by filtration through a packed bed of a pigment removal agent. This new process can be used in physical refining or in caustic refining operations. In the latter, it will be particularly useful in the presence of high soap levels, that is, even in the absence of the water wash centrifuge treatment typically required following caustic treatment. The disclosed method produces commercially acceptable oil products having substantially lowered concentrations of the indicated impurities.

For purposes of this specification, the term "impurities" refers to soaps, phospholipids and chlorophyll. Gums or other mucillagenous materials, if present, are also meant to be included. The phospholipids are associated with metal ions and together they will be referred to as "trace contaminants." The term "glyceride oils" as used herein is intended to encompass both vegetable and animal oils. The term is primarily intended to describe the so-called edible oils, i.e., oils derived from animal fats or from fruits or seeds of plants and used chiefly in foodstuffs, but it is understood that oils whose end use is as non-edibles (i.e., technical grade oils) are to be included as well. The invention is particularly applicable to oils which have been subjected to caustic treatment, which is the refining step in which soaps are formed in the oil. The invention also will find utility in physical refining, where the oil is not contaminated by soaps but where phospholipids are present and where residual gums may be present even following degumming steps.

Refining of crude glyceride oil purifies the oil of many undesirable substances, including gums, pigments (such as green (chlorophyll A), red (carotene) and yellow (xanthophyll) color bodies), phospholipids, free fatty acids and other volatile species that impart undesirable colors, flavors and odors to the oil. Removal of these species results in oil having good appearance, flavor, odor and stability. Many of these species are removed by contacting the oil with an adsorbent (i.e., bleaching earths or amorphous silica).

Crude glyceride oils, particularly vegetable oils, are refined by a multi-stage process, the first step of which typically is "degumming" by treatment with water or with a chemical such as phosphoric acid, citric acid or acetic anhydride. This treatment removes some but not all gums and certain other contaminants. Some of the phosphorus content of the oil is removed with the gums although significant levels of phospholipids still may be present. Either crude or degummed oil may be treated in either a physical or a chemical (caustic) refining process. The physical refining process includes a pretreating and bleaching step, and a steam refining and deodorizing step. No caustic refining step is used. Alternatively, the oil may be refined by a chemical process including neutralization (caustic treatment), bleaching and deodorization steps.

In chemical refining, the addition of an alkali solution, caustic soda for example, to a crude or degummed oil causes neutralization of free fatty acids to form soaps. This step in the refining process will be referred to herein as "caustic treatment" and oils treated in this manner will be referred to as "caustic treated oils." Soaps generated during caustic treatment are an impurity which must be removed from the oil because they have a detrimental effect on the flavor and stability of the finished oil. Moreover, the presence of soaps is harmful to the adsorbents used in vacuum bleaching and to the catalysts used in the oil hydrogenation process.

Current industrial practice is to first remove soaps by centrifugal separation (referred to as "primary centrifugation"). In this specification, oils which have been subjected to caustic treatment and primary centrifugation will be referred to as "partially refined" oil. Conventionally, the caustic refined oil, which still has significant soap content, is subjected to a water wash, which dissolves the soaps from the oil phase into the aqueous phase. The two phases are separated by centrifugation, although complete separation of the phases is not possible, even under the best of conditions. The light phase discharge is water-washed oil which now has reduced soap content. The heavy phase is a dilute soapy water solution. Frequently, the water wash and centrifugation steps must be repeated in order to reduce the soap content of the oil below about 50 ppm. The water-washed oil (or "refined" oil) is often dried to remove residual moisture to between about 2500 and about 1000 parts per million. The dried oil is then either transferred to the bleaching process or is shipped or stored as refined oil.

A significant part of the waste discharge from the caustic refining of vegetable oil results from the water wash centrifuge step used to remove soaps. In addition, in the caustic refining process, some oil is lost in the water wash process. Moreover, the dilute soapstock must be treated before disposal, typically with an inorganic acid such as sulfuric acid in a process termed acidulation. It can be seen that quite a number of separate unit operations make up the soap removal process, each of which results in some degree of oil loss. The removal and disposal of soaps and aqueous soapstock is one of the most considerable problems associated with the caustic refining of glyceride oils.

In addition, color bodies and phosphorus-containing trace contaminants must be removed from the oil. The presence of these trace contaminants can lend off colors, odors and flavors to the finished oil product. These compounds are phospholipids, with which are associated ionic forms of the metals calcium, magnesium, iron and copper. For purposes of this invention, references to the removal or adsorption of phospholipids is intended also to refer to removal or adsorption of the associated metal ions. In the removal of color bodies, attention is primarily given to the removal of chlorophyll.

Clays or bleaching earths commonly have been used for removing phospholipids and color bodies from glyceride oils by batch addition to the vacuum bleacher. These adsorbents may be used in their naturally occurring form or they may be acid-activated prior to use (U.S. Pat. No. 4,443,379 (Taylor et al.)). It is also known that amorphous silicas may be used in the oil refining process. U.S. Pat. No. 4,629,588 (Welsh et al.) teaches the utility of amorphous silica adsorbents for the removal of trace contaminants, specifically phospholipids and associated metal ions, from glyceride oils.

In current refinery practice, chlorophyll is most efficiently removed from glyceride oils by the use of acid-activated clays. Although commonly used in the industry, clays and bleaching earths suffer from a number of disadvantages. They typically do not filter well and require the addition of costly filter aids. Clays are associated with significant oil losses. Moreover, the presence of soaps and phospholipids in the oil is known to interfere with the clays' ability to remove chlorophyll. It is for this reason that one or more water wash centrifuge steps typically are required in caustic refined oil operations, in order to remove the soaps before the oil contacts the clay or bleaching earth.

Due to the presence of soaps (in chemically refined oil) or phospholipids (in physically refined oil), it has not previously been possible to use bleaching earths and clays in a packed bed format as taught by this invention. Conventionally, the bleaching material is added in a batch or slurry format and is subsequently filtered from the oil. It is known that chlorophyll removal capacity increases as the filter becomes coated with clay, thus forming a packed bed in situ through which the oil is filtered. The industry has attempted to take advantage of this packed bed (or "press bleach") effect by partially pre-coating th filter with a portion of the clay, perhaps up to about 20%, with the remainder being added to the vacuum bleacher in the usual (batch or continuous) fashion. This mixed addition format approach is the closest the industry has been able to get to utilizing a packed bed for decolorization of the oil. The mixed addition format initially yields filtered oil with a high chlorophyll content which drops over time as the packed bed builds up. However, due to the relatively short filter life achieved by this mixed approach, by the time chlorophyll removal capacity is maximized by the build-up of the bed, the filter must be changed.

Thus, although the advantages of a packed bed have been recognized in terms of chlorophyll removal, attempts to utilize a strictly packed bed operation in practice have been frustrated. Even where caustic treated oil is subjected to water wash centrifuge steps, too much residual soap and phospholipid remains to allow the use of a packed bed exclusively. A layer of slime quickly builds up on the oil/clay interface, causing severe pressure drop and preventing throughput of the oil. Residual gums and phospholipids present in physically refined oil cause similar sliming problems and pressure drop. The filter life is extremely short. Where no water wash centrifuge step is used, a packed bed would be completely nonfunctional. Prior art use of a packed bed in this process has therefore been limited to only partially pre-coating the filter, while still using continuous clay or bleaching earth addition in the vacuum bleacher (i.e., a semi-batch process).

SUMMARY OF THE INVENTION

A simple dual phase adsorption and treatment process has been found for removal of soaps, phospho-lipids and chlorophyll from chemically or physically refined glyceride oils. This unique process eliminates impurities which poison decolorizing materials and utilizes the latter materials in a packed bed format. The dual phase process described herein utilizes a first phase in which the oil is contacted with amorphous silica adsorbents to remove all or substantially all soaps or gums or both from the oil and reduce the phospholipid content of the oil. In conjunction with the use of silica to remove these impurities, a second phase is utilized in which the oil is filtered through a packed bed of a pigment removal agent in order to decolorize the oil.

It is a primary object of this invention to provide an adsorption and treatment process in which a pigment removal agent can be employed in a packed bed format for efficient oil decolorization. This dual phase process allows adsorbent usage to be optimized. A dramatically higher chlorophyll capacity, for example, will be realized by the pigment removal agent when used in the manner of this invention.

It is an additional object to improve quality control of the refined oil in terms of ensuring that the composite oil (that is, the total volume of refined oil out of bleaching at any particular point in time) meets industry specifications for soaps, phospholipids and color. A related object is to offer a process in which the contact time between the oil and clay or bleaching earth can be minimized, thereby reducing the opportunity for side reactions which are deleterious to the oil quality.

It is a further object to provide a process in which the on-stream filter life can be more than doubled by conserving the decolorizing capacity of the pigment removal agent. It is thereby intended to make more efficient use of the pigment removal agent than is currently realized in the prior art vacuum bleaching operations.

It is also intended that the process of this invention provide tremendous advantage in chemical refining of glyceride oils by eliminating the several unit operations required when conventional water-washing, centrifugation and drying are employed to remove soaps from the oils. Over and above the cost savings realized from this tremendous simplification of the oil processing, the overall value of the product is increased since a significant by-product of conventional caustic refining is dilute aqueous soap-stock, which is of very low value and requires substantial treatment before disposal is permitted by environmental authority.

It is further intended, for embodiments utilizing bleaching earth or clay as the pigment removal agent, that reduction of the overall adsorbent usage will result in substantial oil conservation as this step typically results in significant oil loss. Moreover, since spent bleaching earth has a tendency to undergo spontaneous combustion, reduction of clay usage will yield an occupationally and environmentally safer process.

DETAILED DESCRIPTION OF THE INVENTION

A dual phase adsorption and treatment process allows for easy and efficient removal of soaps, gums, phospholipids and pigments from glyceride oils in a single unit operation. In the first phase, an amorphous silica adsorbent is used to remove soaps or gums or both, and phospholipids from the oil. In the second phase, a pigment removing agent is used in a packed bed to decolorize the oil. The process essentially comprises the steps of selecting a glyceride oil which contains impurities selected from the group gums, soaps and phospholipids, and which also contains pigments, contacting the oil with a sufficient quantity of an amorphous silica adsorbent to reduce the levels of the impurities (gums, soaps and phospholipids) to levels which are noninhibitory to operation of the packed bed of pigment removal agent, and passing the silica adsorbent-treated oil through a packed bed comprising a pigment removal agent. At least about 50% of the total quantity of the pigment removal agent used in the adsorption and treatment process is contained in the packed bed.

This invention may be employed with physically refined oil for the removal of gums, phospholipids and pigments. The invention also may be employed with chemically refined oils for the removal of gums, soaps, phospholipids and pigments. The presence of increasing soaps in the oil actually enhances the capacity of amorphous silica to adsorb phospholipids. The use of silica adsorbents to remove phospholipids and soaps or gums or both, in conjunction with a packed bed of a pigment removal agent very clearly protects the capacity of that agent to decolorize the oil.

The Oils

The process described herein can be used for the removal of impurities from any glyceride oil, for example, oils of soybean, peanut, rapeseed (canola), corn, sunflower, palm, coconut, olive, cottonseed, etc. or animal fats. The following description will focus on the treatment of caustic treated oils for the removal of soaps, phospholipids and chlorophyll. However, this invention also may be used with physically refined oil to remove gums, phospholipids and chlorophyll. Additionally, the invention may be used to treat oil in which chlorophyll levels are not problematic, in order to remove other pigments or impurities. For example, it may be desired to remove phospholipids and reduce red colors in palm oil by the method of this invention. Any of these other oils may be substituted for the caustic treated oils of the following disclosure.

The caustic refining process involves the neutralization of the free fatty acid content of crude or degummed oil by treatment with bases, such as sodium hydroxide or sodium carbonate, which typically are used in aqueous solution. The neutralized free fatty acid present as the alkali or alkaline earth salt is defined as soap. The soap content of caustic treated oil will vary depending on the free fatty content of the unrefined oil.

Values disclosed as typical in the industry are stated as about 300 ppm soap for partially refined (caustic treated, primary centrifuged) oil (Erickson, Ed., Handbook of Soy Oil Processing and Utilization, Chapter 7, "Refining," p. 91 (1980)), but in practice, soap levels at this stage may range up to 500 to 1000 ppm. Conventional separation and water wash centrifuge processes remove about 90% of the soap content generated by the caustic treatment step. Levels of 10–50 ppm soap are taught for refined oil (that is, caustic treated oil that has been primary centrifuged and fully water washed) (Christenson, Short Course, Processing and Quality Control of Fats and Oils, FIG. 1, presented at Amer. Oil Chemists' Soc. (May 5–7, 1983) and Erickson, p. 92). These values are summarized in Table I.

Fully refined oils must have soap values approaching zero. The process disclosed herein will reduce soaps to levels acceptable to the industry, even where incoming oil contains up to 600 ppm soap following caustic treatment and primary centrifuge, or even higher in the absence of primary centrifugation. Of course, the dual phase process is not restricted to use only at these very high soap values. It also will be advantageously used to treat refined oil having soap levels of 10–50 ppm. The dual phase process of this invention will reduce soap levels to less than about 10 ppm, preferably less than about 5 ppm, most preferably about zero ppm. However, the process is not limited to use in the presence of soaps, but can be used to treat soap-free oils also.

Removal of trace contaminants (phospholipids and associated metal ions) from edible oils is required in the oil refining process because they can cause off colors, odors and flavors in the finished oil. Typically, the acceptable concentration of phosphorus in the finished oil product should be less than about 15.0 ppm, preferably less than about 5.0 ppm, according to general industry practice. As an illustration of the refining goals with respect to trace contaminants, typical phosphorus levels in soybean oil at various stages of chemical refining are shown in Table I.

TABLE I[1]

| Stage | Trace Contaminant Levels (ppm) P | Ca | Mg | Fe | Cu | Soaps (ppm) | ChlA (ppm) |
|---|---|---|---|---|---|---|---|
| Crude Oil | 450–750 | 1–5 | 1–5 | 1–3 | .03–.05 | 0 | 0.3–2.0 |
| Degummed Oil | 60–200 | 1–5 | 1–5 | .4–.5 | .02–.04 | 0 | 0.3–2.0 |
| Caustic Treated Oil[2] | 60–750 | 1–5 | 1–5 | .4–.3 | .02–.05 | 7500–12,500 | 0.3–2.0 |
| Partially Refined Oil[3] | 60–200 | 1–5 | 1–5 | .4–.5 | .02–.04 | 300–1000 | 0.3–2.0 |
| Refined Oil[4] | 10–15 | 1 | 1 | 0.3 | .003 | 10–50 | 0.3–2.0 |
| End Product | 0–15 | 1 | 1 | .1–.3 | .003 | 0 | ≦.05–.20 |

[1]Data assembled from the Handbook of Soy Oil Processing and Utilization, Table I, p. 14, p. 91, p. 119, p. 294 (1980); from FIG. 1 from Christenson, Short Course: Processing and Quality Control of Fats and Oils, presented at American Oil Chemists' Society, Lake Geneva, WI (May 5–7, 1983); and from field data.
[2]Either Crude Oil or Degummed Oil may be used to prepare Caustic Treated Oil.
[3]Oil that has been caustic treated and primary centrifuged.
[4]Oil that has been caustic treated, primary centrifuged and water wash centrifuged.

In addition to phospholipid removal, the process of this invention also removes from edible oils ionic forms of the metals calcium, magnesium, iron and copper, which are believed to be chemically associated with phospholipids, and which are removed in conjunction with the phospholipids. These metal ions themselves have a deleterious effect on the refined oil products. Calcium and magnesium ions can result in the formation of precipitates, particularly with free fatty acids, resulting in undesired soaps in the finished oil. The presence of iron and copper ions promote oxidative instability. Moreover, each of these metal ions is associated with catalyst poisoning where the refined oil is catalytically hydrogenated. Typical concentrations of these metals in soybean oil at various stages of chemical refining are shown in Table I. Throughout the description of this invention, unless otherwise indicated, reference to the removal of phospholipids is meant to encompass the removal of associated metal ions as well.

Residual gums and other mucillagenous materials may be present in the oil, even after conventional degumming procedures. While low levels of gums are not deleterious to the oil itself, their presence would make the use of packed bed filtration difficult or impossible due to slime formation on the packed bed materials at the oil/adsorbent interface.

The dual phase process described herein very effectively and efficiently removes pigments (or color bodies) from glyceride oil without the use of solvents (i.e., without using miscella refining). The pigments of interest in oil refining are green (chlorophyll), red (carotene) and yellow (xanthophyll). It is chlorophyll A which is of greatest concern here, but references herein to chlorophyll will be understood to refer to all relevant forms of chlorophyll, or their degradation products, such as pheophytin. In addition, reference to removal or reduction of chlorophyll also shall refer to decolorization of the oil in general, that is, it shall also be intended to encompass removal or reduction of red and yellow color bodies, whether or not in the presence of chlorophyll, unless otherwise noted.

Chlorophyll is produced only in plants and this invention is therefore intended primarily for use with vegetable oils. However, it may be desired to treat animal fats and tallows, or other oils which contain little or no chlorophyll, in order to remove dietary chlorophyll or for removal of other color bodies. Removal of chlorophyll from vegetable oils is a significant step in refining vegetable oils because the chlorophyll imparts an unacceptably high level of green coloring to the oil. In addition, chlorophyll has been implicated as a factor in the instability of oils on exposure to light. Chlorophyll levels vary dramatically from oil to oil, as well as from crop to crop, depending on growing and harvesting conditions. Although target chlorophyll values vary from refiner to refiner, the target values for bleached oils and for deodorized oils typically are in the range of about 0.05 to about 0.20 ppm or less, as shown in Table I.

In referring to caustic treated, partially refined and refined glyceride oils, it is intended to refer only to oils in the form in which they normally would result from those well-established refining processes. It is not intended, for example, to include treatment of oil miscella, in which the oil is dissolved in quantities of a solvent such as hexane. In the refining process in which this invention will be employed, solvents used in extracting the glyceride oil from seeds will have been removed at a step prior to the dual phase process described here.

The Adsorption and Treatment Materials

Two different types of adsorption and treatment materials are used in this dual phase process. In the first phase, a material is used which is uniquely able to remove both soaps and phospholipids, especially in the presence of high soap levels. Gums, if present, are also removed in this first phase. The material of choice here is amorphous silica. In the second phase, a pigment removal agent is used which will decolorize the oil. Clay or bleaching earth is preferred.

Silica Adsorbents—The term "amorphous silica" as used herein is intended to embrace silica gels, precipitated silicas, dialytic silicas and fumed silicas in their various prepared or activated forms. The specific manufacturing process used to prepare the amorphous silica is not expected to affect its utility in this method.

In the preferred embodiment of this invention, the silica adsorbent will have a high proportion of its surface area in pores which are large enough to permit access to soap and phospholipid molecules, while being capable of maintaining good structural integrity upon contact with the oil. The requirement of structural integrity is particularly important where the silica adsorbents are used in continuous flow systems, which are susceptible to disruption and plugging. Amorphous silicas suitable for use in this process have surface areas of up to about 1200 square meters per gram, preferably between 100 and 1200 square meters per gram. It is preferred for as much as possible of the surface area to be contained in pores with diameters greater than 50 to 60 Angstroms, although amorphous silicas with smaller pore diameters may be used in the process. In particular, partially dried amorphous silica hydrogels having an average pore diameter ("APD") less than 60 A (i.e., down to about 20 A) and having a moisture content of at least about 25 weight percent will be suitable. The practical upper APD limit is about 5000 A.

The preferred porosity for soap and phospholipid adsorption may be achieved by the creation of an artificial pore network of interparticle voids in the 50 to 5000 A range. For example, non-porous silicas (i.e., fumed silica) can be used as aggregated particles. Silicas of any porosity may be used under conditions which create this artificial pore network. Thus it is preferred to select amorphous silicas for use in this process which have an "effective average pore diameter" greater than 50 A. This term includes both measured intraparticle APD and interparticle APD, designating the pores created by aggregation or packing of silica particles.

The purity of the amorphous silica used in this invention is not believed to be critical in terms of the adsorption of impurities. However, where the finished products are intended to be food grade oils, care should be taken to ensure that the silica used does not contain leachable impurities which could compromise the desired purity of the product(s). It is preferred, therefore, to use a substantially pure amorphous silica, although minor amounts, i.e., less than about 10%, of other inorganic constituents may be present. For example, suitable silicas may comprise iron as $Fe_2O_3$, aluminum as $Al_2O_3$, titanium as $TiO_2$, calcium as CaO, sodium as $Na_2O$, zirconium as $ZrO_2$, sulfur as $So_4$, and/or trace elements.

Especially preferred are organic acid-treated amorphous silicas. U.S. Pat. No. 4,734,226 (Parker et al.) and U.S. Pat. No. 4,939,115 (Parker et al.) teach that amorphous silicas treated with citric acid, acetic acid, ascorbic acid or tartaric acid to a total volatiles content of at least about 10% are useful for removal of trace contaminants, specifically phospholipids and associated metal ions, from oils. Citric acid-treated amorphous silicas are particularly preferred.

Pigment Removal Agents—The pigment removal agent used in the second phase of this process may comprise any material known to remove pigments from glyceride oil by chemical reaction, physical adsorption or both. This includes but is not limited to activated carbon, acid-treated amorphous silica, and natural or synthetic silica-alumina materials. The silica-aluminas may be acid-activated or non-activated, and may be amorphous or crystalline.

The natural silica-alumina materials comprise clays and bleaching earths. The term "clay" as used herein is intended to embrace natural (i.e., non-acidactivated) and acid-activated clays, bleaching clays and bleaching earths, as these products are variously termed. Clay products are widely known and used in the glyceride oil refining industry. The clays most typically used are sub- or metal-bentonites and fuller's earths. Montmorillonite is the major component of the sub-bentonite clays, which also may contain non-clay components. The fuller's earths are predominantly montmorillonite and attapulgite with small amounts of kaolinite, halloysite, and illite, as well as some non-clay materials. Acid-activation procedures are well known to the industry and are described in U.S. Pat. No. 4,443,379 (Taylor et al.).

Where clay or primarily clay is used, it may be necessary to mix in a filter aid to facilitate processing of the oil through the packed bed. Filter aids such as diatomaceous earth, perlite, sand, or the like may be used. Although it may be desirable or necessary to use a filter aid, the present process minimizes the need for filter aids.

Synthetic silica-alumina materials also have the ability to remove pigments from glyceride oils. These synthetic materials can be amorphous, including for example M-S TM microspherical silica alumina powders (Davison Div., W. R. Grace & Co.-Conn.), or the like. Alternatively, crystalline aluminosilicates, such as zeolites, etc., may be used as pigment removal agents in this process.

It also has been found that amorphous silicas, such as those described in the preceeding section, can be effective chlorophyll removal agents if they first are pretreated with an acid. Use of amorphous silica treated in this manner for the removal of phospholipids and color bodies from glyceride oil is taught in U.S. Pat. No. 4,781,864 (Pryor et al.) and U.S. Pat. No. 4,877,765 (Pryor et al.). Acids suitable for preparation of the acid-treated silica adsorbent can be of any type—inorganic, organic or acidic salt—but must have a $pK_a$ of about 3.5 or lower. Inorganic acids are preferred. In the preferred embodiment, the acid will be a mineral acid, with the stronger acids being the most effective. Sulfuric acid is the most preferred, both for its effectiveness and for its ability to remain supported on the silica. Phosphoric acid is effective for adsorption, but has a tendency to come off the silica into the oil, which may make it less desirable in certain applications. Alternatively, hydrochloric acid may be used. The acids may be used singly or in combination.

Strong organic acids also may be supported on the silica for use in this invention. Typically, these will be modified organic acids such as toluene sulfonic acid, trifluoroacetic acid and the like. Alternatively, acidic salts, such as magnesium sulfate, aluminum chloride, aluminum sulfate and the like, may be used in this invention.

The possible acid-base interaction of the acid with the support should be considered when selecting the two materials. The pH of the acid-treated adsorbent should be less than or equal to about 3.0 when measured as the pH of a 5.0 wt% (dry basis) slurry of the adsorbent in de-ionized water. In other words, there should be sufficient free acid available in the acid-treated adsorbent beyond any amounts of acid which may interact with the support material. The acid content of the acid-treated adsorbent should be at least about 1.0 wt %, preferably about 3.0 to about 10.0 wt %, and most preferably about 5.0 wt %, based on the dry weight of the amorphous silica. Persons of ordinary skill in the art will be capable of selecting appropriate acids for support on the amorphous silica in order to achieve this overall product pH.

Treatment of the silica may be with neat acid or with an aqueous acid solution. The acid strength and concentration on the support should be such that:

$$\text{Acidity Factor} = K_a \times \frac{\text{Moles of Acid}}{\text{Grams of Support}} \geqq 2.0 \times 10^{-8}$$

where $K_a$ is the dissociation constant of the acid. It will be appreciated that the acid strength and concentration may be easily adjusted to achieve an acidity factor in this range.

It is desired to support a sufficient amount of acid on the silica such that the total volatiles content of the acid-treated silica is about 10 wt % to about 80 wt %, preferably at least about 30 wt %, and most preferably about 40 to 80 wt %.

The amorphous silica can be treated with the acid or acidic solution in several ways. First, the silica may be slurried in the acidic solution for long enough for the acid to enter the pores of the silica, typically a period of at least about one half hour, up to about twenty hours. The slurry preferably will be agitated during this period to increase entry of the acid into the pore structure of the amorphous silica. The acid-treated silica is then conveniently separated from the solution by filtration and may be dried to the desired total volatiles content.

Alternatively, the acid solution can be introduced to the amorphous silica in a fixed bed configuration, for a similar period of contact. This would be particularly advantageous for treating unsized, washed silica hydrogel, since it would eliminate the standard dewatering-/filtration step in processing the hydrogel. A third method is by introducing a fine spray or jet of the organic solution into the amorphous silica as it is fed to a milling/sizing operation or at any other convenient step. These latter two methods will be preferred for treating silica in a commercial scale operation.

Any of the pigment removal agents described above may be used alone in the packed bed of this invention, with or without a filter aid. Alternatively, two or more agents may be used together in the packed bed, either mixed or serially, and again, either with or without filter aid.

The Adsorption Process

The process of this invention presents a dual phase adsorption and treatment operation. In the first phase, soaps, soaps and phospholipids, or gums and phospholipids are removed from the oil by contact with amorphous silica. In the second phase, the oil is put through a packed bed comprising a pigment removal agent for removal of pigments. Both phases employ non-miscella refining. That is, the oil is not in a solvent solution or miscella.

As discussed above, amorphous silicas are to be used as the adsorbent in the first phase of this process. They are particularly well suited for removing both soaps and phospholipids from caustic treated or partially refined glyceride oils. The capacity of the silica for adsorbing phospholipids is actually improved with increasing soap levels in the starting oil, provided that sufficient silica is used to obtain adsorbent-treated oil with soap levels of approximately 30 ppm or less. It is when the residual soap levels (in the adsorbent-treated oil) are reduced to below about 30 ppm that the increased capacity of the silica for phospholipid adsorption is seen. It is believed that the total available adsorption capacity of amorphous silica is about 50 to 150 wt. % on a dry basis.

The silica usage should be adjusted so that the total soap and phospholipid content of the caustic treated or partially refined oil does not exceed about 50 to 150 wt.

% of the silica added on a dry basis. The maximum adsorption capacity observed in a particular application is expected to be a function of the specific properties of the silica used, the oil type and stage of refinement, and processing conditions such as temperature, degree of mixing and silica-oil contact time. Calculations for a specific application are well within the knowledge of a person of ordinary skill as guided by this specification.

The soap and phospholipid reduction is accomplished by contacting the amorphous silica and the oil in a manner which facilitates the adsorption. This adsorption step may be by any convenient batch or continuous process. Agitation or other mixing will enhance the adsorption efficiency of the silica. It is preferred that the silica be added in a continuous or semi-continuous manner. It is also preferred to contact the oil and silica in the substantial absence of pigment removal agent, although some quantities of the latter may be present in alternative embodiments.

The caustic refined oil and amorphous silica are contacted as described above for a period sufficient to substantially remove the soaps and phospholipids from the oil. Residual quantities may remain but these must be sufficiently minor so as not to create sliming and blockage of the packed bed in the second phase of this process. The specific contact time will vary somewhat with the adsorbent usage, that is, the relative quantity of amorphous silica adsorbent and the pigment removal agent which are brought into contact with the oil. The adsorbent usage is quantified as the weight percent of the materials (on a dry weight basis after ignition at 1750° F.), calculated on the basis of the weight of the oil processed. The preferred amorphous silica usage is at least about 0.01 to about 1.0 wt. %, dry basis, most preferably at least about 0.03 to about 0.30 wt. %, dry basis.

Where this process is used to treat physically refined oil, the procedures will be the same. The adsorbent usage will be calculated on the basis of phospholipid content, however, instead of soap content. Here again, it is intended that the impurities be substantially removed. The preferred adsorbent usage will be about 0.01 to about 1.0 wt. % (dry basis). For treatment of oils whose phosphorus levels are reduced to about 5.0 ppm phosphorus or less, the dry basis capacity of amorphous silicas is about 12.0 to about 45.0 wt %.

In the pigment removal phase of the invention, the oil is filtered through a packed bed of a pigment removal agent. The first and second phases of the process may be separated, with the silica being filtered from the oil prior to the oil contacting the packed bed. Alternatively, the spent amorphous silica from the first phase of .he process is removed simultaneously as the oil is passed through the packed bed of pigment removal agent in the second phase. Selection of one of these alternative embodiments will depend on the particular plant set-up. In either case, it is preferred that the silica adsorbent of the first phase and the pigment removal agent of the second phase remain substantially completely unmixed.

In the preferred embodiment of this invention, a filter is pre-coated with a pigment removal agent and the pre-coated filter is used to decolorize the oil. By precoating the filter in the manner of this invention, it is preferred that the full loading of pigment removal agent is presented to the oil in a packed bed. This protects the pigment removal agent from contamination by soaps and phospholipids, thus maintaining the agent's capacity and effectiveness for removing chlorophyll and other color bodies from the oil. More efficient chlorophyll A reduction is consistently obtained by this method than by batch or continuous co-addition or sequential addition of silica and clay.

As stated, in the preferred embodiment, all of the pigment removal agent used in the adsorption and treatment process will be contained in the packed bed as described. The silica adsorbent and the pigment removal agent preferably will remain substantially unmixed, although some incidental mixing may occur at the front end of the packed bed. Although not preferred, less than 100% of the pigment removal agent can be used in the packed bed, with the remainder being added to the oil in the first phase of the process. To the extent that this is done, however, the full benefit of pigment removal capacity is compromised. However, up to about 50% of the pigment removal agent may be added in this manner. That is, for the present invention, at least about 50% of the pigment removal agent should be used in the packed bed, preferably at least about 75%, most preferably 90 to 100%. A filter aid may be used in addition to the pigment removal agent, as described above.

In general, the longer the length of the packed bed in the second phase of this process, the better the utilizaton of the decolorization capacity of the pigment removal agent will be. However, improved capacity must be balanced against the greater pressure drop associated with a longer bed. This type of adjustment is common in industrial processes and will be within the skill of the refiner. The preferred pigment removal agent usage is at least about 0.01 to about 1.0 wt %, dry basis, preferably 0.05 to 0.5 wt %, dry basis. In terms of filter precoat, the usage should be in the range of about 0.3 to about 6.0 pounds per square foot of filter, preferably about 1.0 to about 4.0 pounds.

The process of this invention can be conducted at any convenient temperature at which the oil is a liquid. The preferred temperature will depend on which pigment removal agent is selected, and the optimum temperature can be expected to vary somewhat. In addition, the optimum temperature for each of the two phases of the process is different. If the two process phases are separated, it may be desired to adjust the oil temperature to approximate the optimum for each phase.

In general, higher temperatures result in better decolorization, and it is preferred that the oil be at about 90 to about 120° C. for this stage. Oil temperatures may be as high as 150° C., or even higher in some cases. For the first phase of the invention (that is, for adsorption of gums or soaps and phospholipids), lower oil temperatures are preferred. The oil temperature preferably is about 25 to about 100° C., more preferably about 60 to about 80° C.

It can be seen, then, that some balancing must be done in targeting the oil temperature for this process. Alternatively, the oil may be heated between the first and second phase of the process. Constraints based on the overall refining operation may also be present. For example, where oil is sent to bleaching directly from the previous processing stage, temperatures typically will be at least about 70 to 80° C., which is satisfactory for use here. However, where oil has been stored prior to bleaching, it may be cooler and may require heatLing before or while being treated by the present process.

As seen in the Examples, significant reduction in soap and phospholipid content can be achieved by the method of this invention. The initial soap content and the phosphorus content of the oil will depend primarily on the oil itself, as well as on the silica, usage, process, etc. For example, by reference to Table I, it will be appreciated that the initial soap content will vary significantly depending whether the oil is treated by this adsorption method following caustic treatment alone, or following primary centrifuge or water wash centrifuge. Similarly, the phosphorus content will be somewhat reduced following degumming, caustic treatment, primary centrifuge and/or water wash centrifuge. The first phase of this process will reduce the levels of impurities (i.e., gums, phospholipids, soaps) to levels which are noninhibitory to operation of the packed bed. However, phosphorus levels of less than about 2.0 ppm, preferably substantially zero, and soap levels of less than about 10 ppm and most preferably substantially zero, are achieved by this adsorption method. Gum levels preferably are reduced to less than about 2.0 ppm, preferably substantially zero.

Similarly, chlorophyll levels are reduced in accordance with industry standards, that is, to less than about 0.2, preferably to between about 0.05 and 0.2 ppm, or less. The loading of the pigment removal agent can be adjusted according to the chlorophyll levels of the incoming oil, which are subject to large fluctuation as discussed above. It is already within the skill of refinery operators to vary the quantity of bleaching material relative to the incoming chlorophyll levels in conventional vacuum bleaching processes. Although similar adjustments will be necessary in the process of this invention, significantly less pigment removal agent will be used per volume of treated oil than has been possible in the prior art processes.

The present invention makes it possible to use a fully formed packed bed (i.e., with the entire loading of pigment removal agent) throughout the entire period the filter is on-stream. In addition, filter on-stream times are at least doubled, as compared with the conventional use of clay alone or the co-addition or sequential addition of clay and silica to the oil, followed by filtration. The dual phase treatment of this invention gives the refiner the advantage of optimum materials and filter usage, as well as better quality control.

Quality control of the oil in terms of the impurities addressed by this process is significantly improved. Contrary to the prior art processes, the first oil coming out of the packed bed of this invention contains no chlorophyll at all. As the chlorophyll-removing capacity of the packed bed is filled, the chlorophyll level of the oil leaving the filter begins to rise, as does that of the composite oil (i.e., the full volume of treated oil). Therefore, it is an easy matter to monitor chlorophyll in the composite oil, and to cut off the oil stream before the oil goes out of specification. The composite oil, however, is always within the targeted chlorophyll levels.

This contrasts with prior art processes in which the initially treated oil has high chlorophyll levels, perhaps above specification. In that case, the composite oil may not come within specification for chlorophyll until the filter has been on-stream for several hours and the chlorophyll levels of the oil leaving the filter are low enough to balance the high initial levels. System upsets or shut-downs prior to that time may result in out-of-spec composite oil.

The dual phase process described here results in greatly enhanced removal of key glyceride oil impurities—soaps, phospholipids and pigments. The capacities of pigment removal agents for decolorizing oil are dramatically increased by the ability to use the agents in a packed bed format. At the same time, this is accomplished at greatly reduced adsorbent usages, or, conversely, with greatly extended filter lifetimes. Moreover, this dual phase process allows the water wash step(s) to be entirely eliminated from chemical refining operations, if desired, thereby reducing wastewater processing and costs as well as environmental hazards.

The examples which follow are given for illustrative purposes and are not meant to limit the invention described herein. The following abbreviations have been used throughout in describing the invention:

A—Angstrom(s)
APD—average pore diameter
C—capacity
Ca—calcium
ChlA—chlorophyll A
Cu—copper
°C—degrees Centigrade
db—dry basis
Fe—iron
$ft^2$—square foot
gm—gram(s)
hr—hour(s)
lb—pound(s)
Mg—magnesium
min—minutes
ml—milliliter(s)
P—phosphorus
PL—phospholipids
ppm—parts per million (by weight)
PRA—pigment removal agent
%—percent
S—soaps
wt—weight

EXAMPLE I

Chemically refined soybean oil was treated by the dual phase adsorption and treatment process of this invention. By "refined" is meant oil which has been caustic treated, primary centrifuged and water centrifuged.

A high pressure column reactor system with a sand bath heater was used in this experiment. The refined oil was treated with 1.0 wt % (dry basis) TriSyl TM amorphous silica hydrogel (Davison Div., W. R. Grace & Co.-Conn.) and filtered to remove the spent silica. Analysis for soap and phospholipid content was done at this point. Soap was reduced from 24.0 ppm to zero and phosphorus from 1.0 to below 0.1 ppm, the limit of detection for the analytical test used.

The oil then was passed through the column containing the pigment removal agent (PRA). As shown in Table II, three different agents were tested. M-S TM 13 silica-alumina powder, Grade 135 (Davison Div., W. R. Grace & Co.-Conn.) is a synthetic product which was acid alum treated for one hour at 538° C. and screened on 230 Mesh. Nevergreen$^m$ clay (Harshaw/Filtrol Partnership) is an acid-activated montmorillonite bleaching clay, which was mixed with diatomaceous earth filter aid in a 5:1 ratio of clay-to-earth. TriSyl TM amorphous silica hydrogel was treated with aluminum sulfate. Table II shows the results of using these pigment removal agents in the present dual phase process at different loadings and temperatures.

The data from these trials is tabulated in Table II in a way which compares the performance of the various runs of this Example as might be encountered in a commercial process. This Table quantifies the amount of oil which could be processed over a given quantity of pigment removal agent while meeting a specification of 0.05 ppm chlorophyll A for the processed oil as a composite. That is, the processed oil is pooled to reach the 0.05 ppm level, combining the initial process stream in which the chlorophyll levels will be below 0.05 ppm with the final process stream in which chlorophyll levels will be above 0.05 ppm.

TABLE II

| PRA | PRA Wt (gm) | Oil Temp. | Oil Rate (ml/min) | Gm. Oil Processed | ChlA Capacity[1] | Effective Wt % PRA |
|---|---|---|---|---|---|---|
| MS-13 | 1.50 | 85° C. | 6.0 | 100.0 | 38.5 | 1.50 |
| MS-13 | 1.50 | 100° C. | 2.0 | 336.0 | 129.0 | 0.45 |
| MS-13 | 1.50 | 120° C. | 2.0 | 806.0 | 313.0 | 0.19 |
| NG | 1.25 | 85° C. | 6.0 | 28.0 | 13.0 | 4.50 |
| NG | 0.75 | 100° C. | 2.0 | 89.0 | 70.0 | 0.84 |
| NG | 1.25 | 100° C. | 2.0 | 500.0 | 227.0 | 0.25 |
| NG | 1.25 | 120° C. | 2.0 | 654.0 | 293.0 | 0.19 |
| Al-Sulfate | 1.10 | 100° C. | 2.0 | 481.0 | 245.0 | 0.23 |
| Al-Sulfate | 1.10 | 100° C. | 2.0 | 529.0 | 269.0 | 0.21 |

[1]ChlA Capacity = gm ChlA/gm PRA $\times 10^{-6}$.

EXAMPLE II

Samples of chemically refined soybean oil as in Example I were treated with 1.0 wt % (dry basis) TriSyl TM amorphous silica hydrogel (Davison Div., W. R. Grace & Co.-Conn.) and filtered to remove the spent silica. Next, the oil was treated with several pigment removal agents at 85°, 100° or 120° C. This example was done in a batch process, and does not demonstrate the packed bed process of this invention. Rather, it is offered to demonstrate the effect of temperature on oil decolorization.

The three pigment removal agents tested were: M-S TM 13 silica-alumina powder, Grade 135 (Davison Div., W. R. Grace & Co.-Conn.), Nevergreen TM clay (Harshaw/Filtrol Partnership), and Filtrol 160 TM acid-activated montmorillonite bleaching clay (Harshaw/Filtrol Partnership). The usage of each pigment removal agent is given in Table III in wt % (as is). Chlorophyll removal capacity is calculated as (gm ChlA/gm PRA)×106. The results shown in Table III demonstrate increasing chlorophyll removal capacity with increasing temperature for each of the pigment removal agents tested.

TABLE III

| PRA | Usage Wt %, As Is | Red | Yellow | ChlA Cap. | ChlA (ppm) | Phospholipids (ppm) | Soap |
|---|---|---|---|---|---|---|---|
| | | | 85° Vacuum Bleachings | | | | |
| Blank Oil | — | 1.9 | 70+ | — | 0.63 | <1.0 | 0 |
| MS-13 | 0.10 | 1.7 | 70+ | 80 | 0.55 | <1.0 | 0 |
| MS-13 | 0.20 | 1.6 | 69 | 75 | 0.48 | <1.0 | 0 |
| NG | 0.05 | 1.6 | 70+ | 340 | 0.46 | <1.0 | 0 |
| NG | 0.10 | 1.6 | 69 | 300 | 0.33 | <1.0 | 0 |
| F-160 | 0.05 | 1.6 | 70+ | 360 | 0.45 | <1.0 | 0 |
| F-160 | 0.10 | 1.5 | 66 | 340 | 0.29 | <1.0 | 0 |
| F-160 | 0.30 | 0.7 | 17 | 200 | 0.03 | <1.0 | 0 |
| | | | 100° C. Vacuum Bleachings | | | | |
| Blank Oil | — | 1.8 | 70+ | — | 0.63 | <1.0 | 0 |
| MS-13 | 0.10 | 1.7 | 70+ | 170 | 0.46 | <1.0 | 0 |
| MS-13 | 0.20 | 1.7 | 69 | 115 | 0.40 | <1.0 | 0 |
| MS-13 | 0.30 | 1.4 | 61 | 130 | 0.24 | <1.0 | 0 |
| NG | 0.05 | 1.5 | 70+ | 420 | 0.42 | <1.0 | 0 |

TABLE III-continued

| PRA | Usage Wt %, As Is | Red | Yellow | ChlA Cap. | ChlA (ppm) | Phospholipids (ppm) | Soap |
|---|---|---|---|---|---|---|---|
| NG | 0.10 | 1.5 | 67 | 410 | 0.22 | <1.0 | 0 |
| NG | 0.20 | 1.2 | 49 | 260 | 0.11 | <1.0 | 0 |
| NG | 0.30 | 0.9 | 32 | 193 | 0.05 | <1.0 | 0 |
| F-160 | 0.05 | 1.5 | 70+ | 500 | 0.38 | <1.0 | 0 |
| F-160 | 0.10 | 1.3 | 58 | 430 | 0.20 | <1.0 | 0 |
| F-160 | 0.30 | 0.5 | 11 | 200 | 0.03 | <1.0 | 0 |
| | | | 120° C. Vacuum Bleachings | | | | |
| Blank | — | 1.9 | 70+ | — | 0.63 | <1.0 | 0 |
| MS-13 | 0.10 | 1.5 | 67 | 240 | 0.39 | <1.0 | 0 |
| MS-13 | 0.20 | 1.4 | 57 | 165 | 0.30 | <1.0 | 0 |
| NG | 0.05 | 1.4 | 68 | 640 | 0.31 | <1.0 | 0 |
| NG | 0.10 | 1.3 | 60 | 430 | 0.20 | <1.0 | 0 |
| F-160 | 0.05 | 1.3 | 64 | 660 | 0.30 | <1.0 | 0 |
| F-160 | 0.10 | 1.0 | 43 | 550 | 0.13 | <1.0 | 0 |
| F-160 | 0.30 | 0.4 | 5.3 | 200 | 0.03 | <1.0 | 0 |

EXAMPLE III

Chemically refined soybean oil as in Example I was subjected to the dual phase method of this invention. A 2000.0 ml quantity of oil was treated with 16.3 gm (as is) TriSyl TM amorphous silica hydrogel (Davison Div., W. R. Grace & Co.-Conn.) and then separated from the spent silica. The oil had a measured chlorophyll A content of 0.46 ppm. The oil was then passed through a 3.0 gm packed bed of M-Sm TM 13 silica-alumina powder, Grade 135 (Davison Div., W. R. Grace & Co.-Conn.) that had been acid alum activated as in Example I. The oil eluted during the early stages of this experiment (100/ml) had no measurable chlorophyll A content. When 500 ml had been treated, the outlet ChlA was about 0.1 ppm. At 1000 ml, the outlet ChlA was about 0.2 ppm. At 2000 ml, the outlet ChlA was about 0.3 ppm.

The adsorbent saturation capacity for ChlA using the packed bed format of this invention was roughly seven times greater than that expected based on batch isotherm data. From a simple theoretical viewpoint, assuming negligible co-adsorption effects, the saturation capacity of the fixed bed should equal the extrapolated equilibrium isotherm determined from batch contacting of the adsorbent and oil at various loadings. The expected saturation capacity is determined by extrapolating the isotherm data to the initial ChlA concentration. The packed bed format allows one to approach this capacity in commercial practice while maintaining low contaminant levels in the outlet process stream. However, the seven-fold greater than expected saturation capacity indicates that the complex oil mixture contains as yet unidentified poisons that are effectively removed at the front end of the packed bed. As a result, there is a performance benefit observed in the packed bed that would not be expected from a standard adsorption isotherm analysis. This phenomenon is another reason that the packed bed format is desirable.

EXAMPLE IV

Chemically refined soybean oil, as in Example I, was treated by the dual phase process of this invention in a plant scale operation. The levels of soap, phospholipids and chlorophyll A for the incoming oil are indicated in Table IV, for each of four different runs, one control and three runs which embodied the present invention. In each run, a filter leaf filter was pre-coated with 1.5 pounds Filtrol 160 TM clay (Harshaw/Filtrol Partnership) per square foot of filter. Oil was put through the filter at a rate of 75.0 lb/ft$^2$-hr. Oil temperature was about 82° C. on contacting the silica adsorbent, and about 100° C. on contacting the packed bed of pigment removal agent (clay).

In the control run, no amorphous silica adsorbent was used, in order to demonstrate the poor results obtained in attempting to simply use a packed bed of bleaching clay. Each of the other runs demonstrated the dual phase process of this invention. TriSyl$^m$amorphous silica hydrogel (Davision Div., W. R. Grace & Co.-Conn.) was used in Runs 1 and 2. The citric acidtreated silica hydrogel (Davison Div., W. R. Grace & Co.-Conn.), used in Run 3 was an amorphous silica hydrogel treated with citric acid as taught in U.S. Pat. No. 4,734,226 (Parker et al.). Table IV summarizes the results.

TABLE IV

| | Control | Run 1 | Run 2 | Run 3 |
|---|---|---|---|---|
| Filter ID | B | B | A | B |
| Silica Type | — | TriSyl | TriSyl | Citric-Tr. |
| Wt % As Is | — | 0.36 | 0.17 | 0.12 |
| Wt % Dry Basis | — | 0.13 | 0.060 | 0.042 |
| Hours On Stream | 2.3 | 12.5 | 12.3 | 15.75 |
| Initial Soap, ppm | 270 | 300–400 | 200–280 | 275–580 |
| Final Soap, ppm | 0 | 0 | 0 | 0 |
| Initial PL, ppm[1] | 390 | 360–420 | 300–420 | 240–450 |
| Final PL, ppm | <15.0 | <15.0 | <15.0 | <15.0 |
| S-PL Capacity (wt %, db)[2] | — | 60.0 | 100.0 | 143.0 |
| Initial ChlA, ppm | 0.43 | 0.48–0.61 | 0.46–0.57 | 0.46–0.48 |
| Final ChlA, ppm | 0.12 | 0.09 | 0.07 | 0.07 |
| Composite ChlA, ppm | 0.03 | 0.026 | 0.025 | 0.025 |
| For Composite ChlA = 0.02 ppm: | | | | |
| On Stream, hr | 2.0 | 11.0 | 11.00 | 14.4 |
| Clay Capacity[3] | 41.0 | 270 | 260 | 310 |
| Effecitve Wt % Clay | 1.0 | 0.18 | 0.18 | 0.14 |
| For Composite ChlA = 0.05 ppm: | | | | |
| On Stream, hr | 2.60 | 15.0[4] | 18.0[4] | 23.5[4] |
| Clay Capacity[3] | 155 | 3.5 | 410 | 480 |
| Effective Wt % Clay | 0.77 | 0.13 | 0.11 | 0.085 |

[1]PL = 30 × P.
[2]Hydrogel Capacity for S and PL = ((ΔPL + ΔS)/wt % hydrogel) × $10^{-4}$.
[3]Clay Capacity for Chlorophyll = lb ChlA/lb Clay × $10^6$.
[4]Extrapolated values.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A dual phase adsorption and treatment process for the removal of impurities from glyceride oil comprising:
   (a) selecting a glyceride oil which comprises impurities selected from the group gums, soaps, and phospholipids, and which also comprises pigments,
   (b) contacting said oil with a sufficient amount of an amorphous silica adsorbent to reduce the levels of said impurities to levels which are noninhibitory to operation of the packed bed of step (c), and
   (c) passing said oil through a packed bed of a pigment removal agent, the quantity of said agent in said packed bed being at least about 50% of the total quantity of said agent used in the adsorption and treatment process.

2. The process of claim 1 in which the levels of said impurities, if present, are reduced at least to about 10.0 parts per million soaps and about 2.0 parts per million phosphorus.

3. The process of claim 1 in which said glyceride oil is chemically refined oil which comprises at least parts per million soaps.

4. The process of claim 2 in which said chemically refined glyceride oil comprises at least 300 parts per million soaps.

5. The process of claim 4 in which step (b) reduces the soap content of the glyceride oil to substantially zero parts per million.

6. The process of claim 1 in which said glyceride oil comprises phospholipids and step (b) of said process reduces the phosphorus content of the glyceride oil to substantially zero.

7. The process of claim 1 in which said glyceride oil comprises chlorophyll A and said process reduces the chlorophyll A content of the glyceride oil to below about 0.2 parts per million.

8. The process of claim 7 which reduces the chlorophyll content to below about 0.05 parts per million.

9. The process of claim 1 in which said amorphous silica is selected from the group consisting of silica gels, precipitated silicas, dialytic silicas, and fumed silicas.

10. The process of claim 9 in which said silica gel is a hydrogel.

11. The process of claim 9 in which said silica is an organic acid-treated amorphous silica.

12. The process of claim 1 in which the loading of amorphous silica in step (b) is at least about 0.01 weight percent, dry basis, up to about 1.0 weight percent, dry basis.

13. The process of claim 1 in which the oil is separated from the amorphous silica prior to step (c).

14. The process of claim 1 in which said packed bed consists of a filter which has been pre-coated with said pigment removal agent.

15. The process of claim 1 in which said packed bed comprises at least about 75% of the total quantity of pigment removal agent used.

16. The process of claim 1 in which said packed bed comprises at least 90% of the pigment removal agent used.

17. The process of claim 1 in which said packed bed comprises the total quantity of the pigment removal agent used.

18. The process of claim 1 in which said amorphous silica adsorbent and said pigment removal agent are substantially completely unmixed.

19. The process of claim 1 in which about 0.3 to about 6.0 pounds of pigment removal agent per square foot of filter is used.

20. The process of claim 19 in which about 1.0 to about 4.0 pounds of pigment removal agent per square foot of filter is used.

21. The process of claim 1 in which said pigment reducing agent is a natural or synthetic silica alumina material, activated carbon or an acid-treated amorphous silica having an acidity factor of at least about $2.0\times10^{-8}$ and a pH of about 3.0 or lower.

22. The process of claim 21 in which said pigment removal agent is mixed with a filter aid.

23. The process of claim 21 in which said natural silica alumina composition is acid-activated or non-acid-activated bleaching earth or clay.

24. The process of claim 23 in which said bleaching earth or clay is sub- or metal-bentonite or fuller's earth.

25. The process of claim 21 in which said synthetic silica alumina material is an amorphous silica alumina powder.

26. The process of claim 21 in which said silica alumina material is a crystalline silica alumina.

27. The process of claim 26 in which said crystalline silica alumina is a zeolite.

28. The process of claim 21 in which said acid-treated amorphous silica has been treated with an inorganic acid, a strong organic acid or an acid salt.

29. The process of claim 28 in which said inorganic acid is sulfuric acid, phosphoric acid or hydrochloric acid.

30. The process of claim 1 in which the temperature of said glyceride oil is at least about 70° C.

31. The process of claim 30 in which the oil temperature is at least about 90° C.

32. A method for increasing the capacity of pigment removal agents for removing chlorophyll from glyceride oils, consisting of placing said pigment removal agent in a packed bed and contacting said packed bed with glyceride oil that has been pre-treated with an amorphous silica adsorbent to reduce the levels of soaps or phospholipids or both to levels which are noninhibitory to operation of said packed bed.

33. In a method for removing pigment from glyceride oils which comprise impurities selected from the group gums, soaps and phospholipids by contacting said oils with a pigment removal agent, the improvement consisting of:

(a) first contacting said oil with a sufficient amount of amorphous silica adsorbent to reduce the levels of said impurities to levels which are noninhibitory to operation of the packed bed of step (b), and (b) next passing said oil through a packed bed of a pigment removal agent, the quantity of said agent in said packed bed being at least about 50% of the total quantity of said agent used in the process.

* * * * *